United States Patent [19]

Cockram et al.

[11] Patent Number: 5,004,960

[45] Date of Patent: Apr. 2, 1991

[54] IGNITION DEVICE FOR A GAS DISCHARGE LAMP

[75] Inventors: David J. Cockram; Edgar S. R. Cockram, both of Johannesburg, South Africa

[73] Assignee: Actronic Lighting CC, Edenvale, South Africa

[21] Appl. No.: 458,086

[22] Filed: Dec. 28, 1989

Related U.S. Application Data

[63] Continuation-in-part of Ser. No. 181,496, Apr. 13, 1988, abandoned.

[51] Int. Cl.[5] ..... H05B 41/36

[52] U.S. Cl. ..... 315/307; 315/209 R; 315/DIG. 7

[58] Field of Search ..... 315/307, 289, 205, 209 R, 315/DIG. 2, DIG. 5, DIG. 7, 276

[56] References Cited

U.S. PATENT DOCUMENTS

| | | | |
|---|---|---|---|
| 4,117,377 | 9/1978 | Jimerson et al. | 315/209 R |
| 4,331,905 | 5/1982 | Owen | 315/289 X |
| 4,511,195 | 4/1985 | Barter | 315/307 X |
| 4,766,350 | 8/1988 | Hüsgen et al. | 315/307 X |

*Primary Examiner*—Eugene R. LaRoche
*Assistant Examiner*—Ali Neyzari
*Attorney, Agent, or Firm*—John P. White

[57] ABSTRACT

The invention provides an ignition device for a gas discharge lamp. The device comprises a voltage multiplier which is connected to an AC mains source. A pulse generator is connected to the voltage multiplier and produces a trigger pulse when the source voltage exceeds a predetermined threshold. The output of the pulse generator is applied to a resonant network including a step-up transformer, which applies high voltage ignition pulses to the lamp. A delay circuit synchronizes the ignition pulses with the peaks of the AC mains waveform.

8 Claims, 2 Drawing Sheets

IGNITION DEVICE FOR A GAS DISCHARGE LAMP

This Application is a Continuation-in-Part of U.S. Pat. Application Ser. No. 181,496 filed on Apr. 13, 1988, now abandoned.

BACKGROUND OF THE INVENTION

This invention relates to an ignition device for a gas discharge lamp.

Gas discharge lamps are usually driven by a source of alternating electrical current and are controlled by means of a regulating device such as an inductive choke or an electronic "ballast" circuit, which controls the lamp voltage and current, together with an ignition device to provide high voltage pulses which initiate the discharge arc in the lamp. The ignition device must only operate until the lamp ignites and must then be disabled. Such ignition devices can be controlled by manual switches, timers or voltage detection circuits.

The ignition pulse voltage which is required to ignite the lamp may be in the region of 20 to 65 kV. Because of the large step up ratios required to obtain such voltages from a standard AC mains voltage, step-up transformers which are used in typical igniters tend to be bulky and costly. To reduce the cost of such transformers, they are usually short-time rated to allow small frame sizes to be utilised, and multiple stages may be used to overcome insulation breakdown problems which may otherwise occur due to the high voltages involved. Due to the higher voltages necessary for re-ignition of a hot lamp (say, three or four times the cold ignition voltages), and the difficulty of achieving these voltages from normal mains supplies, hot lamp re-ignition is often not provided for commercially available ignition devices.

Certain ignition devices incorporate spark-gap oscillators which operate at high voltages and which are sensitive to changes in humidity and atmospheric pressure. Such devices may wear or need adjustment, which is a disadvantage.

In order for ignition to occur reliably, the lamp ignition pulse should be applied at or near the peak of the electrical waveform applied to the lamp. The ionisation caused by the ignition pulse dissipates rapidly in high pressure lamps such as high pressure sodium or metal halide lamps, so that timing is more critical with such lamps than with relatively low pressure lamps such as low pressure sodium or fluorescent lamps. The timing of the pulse is even more critical when the lamp is at full working temperature and must be restarted, since its internal pressure will then be at its highest level.

Known lamp ignition circuits produce a rapid sequence of high power, high frequency pulses in the hope that one of the pulses will be applied to the lamp close enough to he waveform peak of the lamp electrical supply to cause ignition. Such a system obviously has a relatively high power consumption, since many more pulses are provided than are required to start the lamp. Due to the large number of applied pulses and the power contained in them, the radio frequency interference (RFI) generated is considerable.

SUMMARY OF THE INVENTION

According to the invention there is provided an ignition device for a gas discharge lamp which is driven by a source of electrical current having a periodic waveform, the device comprising a voltage multiplier which is adapted to be connected to the source and to provide an output having a higher voltage than that of the source; a pulse generator adapted to be driven by the output and to produce trigger pulses; sensing means for sensing the voltage of the source and for enabling the pulse generator when the voltage of the source exceeds a predetermined level; timing means associated with the sensing means and the pulse generator and adapted to synchronise the enabling of the pulse generator with the occurrence of a peak in the waveform of the electrical source; and a resonant network having a primary winding to which the trigger pulses from the pulse generator are applied and a secondary winding which is in circuit with the lamp and which applies high-voltage ignition pulses to the lamp when the trigger pulses are applied to the primary winding, the ignition device thereby providing ignition pulses to the lamp automatically whenever the voltage of the source increases beyond the predetermined level, the ignition pulses being synchronised with peaks in the waveform of the electrical source.

DESCRIPTION OF AN EMBODIMENT

Figure 1:
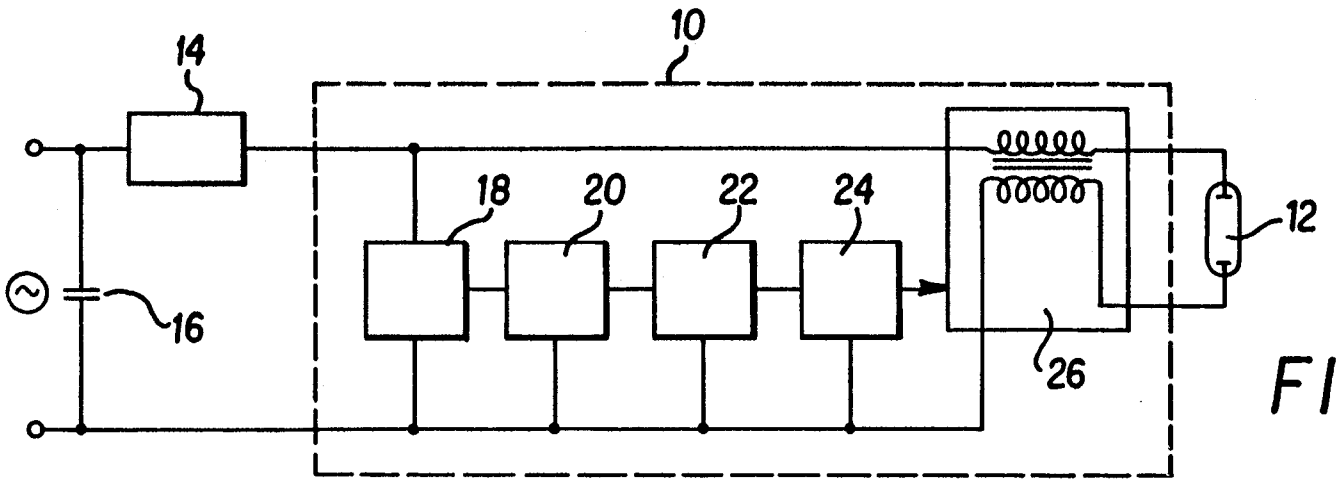
FIG. 1 is a block schematic diagram of an ignition device for a gas discharge lamp according to the invention.

FIG. 1 shows the ignition device in simplified block diagram form. An ignition device 10 is interposed between a gas discharge lamp 12 and a conventional voltage/current regulating device 14, which may be an inductive choke or another regulating device (ballast). The entire circuit is connected to an AC mains electrical source which has a sinusoidal periodic waveform. A parallel capacitor 16 provides power factor correction. The source will typically have a nominal voltage of 220 V, but could be a 110 V source.

The ignition device 10 comprises four basic circuit blocks, a voltage multiplier 18, a voltage sensing circuit and regulator 20, a delay circuit 22, a pulse generator circuit 24 and a resonant network 26. Basically, the ignition device operates as follows. When the lamp 12 is off and the circuit is connected to the mains electrical supply, the mains voltage appears at the input to the ignition device 10. The mains voltage is multiplied by a predetermined factor in the voltage multiplier 18. The mains voltage (or the increased output voltage of the voltage multiplier 18, which is directly related to the mains voltage) is applied to the voltage sensor/regulator 20, which in either case effectively senses the mains voltage and provides a regulated supply derived from the increased output voltage to the pulse generator circuit 24 when the mains voltage exceeds a predetermined level, after a delay determined by the delay circuit 22. When the regulated supply is provided to the circuit 24, the oscillator of the pulse generator starts automatically and provides a trigger pulse to the resonant network 26. The network 26 includes a superimposing transformer which steps up the trigger pulse and applies a high voltage pulse to the lamp 12 to cause ignition.

When ignition is achieved, the lamp load causes the voltage at the input of the ignition device 10 to drop, which causes the output of the voltage multiplier 18 to fall below the predetermined threshold level of the voltage sensor/regulator 20. The voltage sensor/-regulator 20 removes the regulated supply to the pulse generator 24 and the ignition pulses cease.

The ignition device 10 will now be described in greater detail, with reference to FIG. 2. The voltage multiplier 18 comprises a diode/capacitor voltage multiplier which includes two diodes D2 and D3, and two capacitors C1 and C2, and doubles the 220V AC mains voltage which is applied to the input of the ignition device 10. In the case of a 110V source, a voltage quadrupler may be used instead of a doubler.

The pulse generator 24 comprises an electronic switch Q3 in conjunction with the diodes D2 and D3. The switch Q3 is typically a reverse blocking thyristor. The switch Q3 is arranged to switch the output of the voltage multiplier through a primary winding 28 of a step-up transformer 30. Together with the capacitors C1 and C2, the primary winding 28 forms a resonant LC network which oscillates at a high frequency (typically in the range 2 to 5 MHz, although frequencies of 100 kHz or lower, or up to 1 GHz and higher are possible). Thus, a single trigger pulse switched through the primary winding 28 by the switch Q3 causes a short pulse, effectively comprising a brief, decaying pulse train, to be generated in the resonant circuit, at the resonant frequency. The trigger pulse is repeated for each positive-going cycle of the mains waveform. The tigger pulse is transformed to a high voltage in the dual secondary windings 32 of the transformer 30 and applied to the lamp 12, causing ionisation of the gas in the lamp and thereby facilitating ignition. The diodes D2 and D3 act together as a catch diode to pass the energy that would be blocked by the switch Q3 when it switches off.

A diode D1 acts as a polarity detector to ensure that ignition pulses are only applied by the circuit when the mains waveform has the correct polarity. The voltage sensor/regulator circuit 20 comprises a zener diode Z1, resistors R3, R4, R6, R7 and R8, as well as a zener diode Z2. The voltage rating of the zener diode Z1 and the resistors determine the point at which an electronic switch Q2 is turned on. The rating of the zener diode Z1 is typically close to 220 V, so that current is only mains waveform exceeds this value. The level is chosen to be between approximately 80% and 100% of the peak voltage of the mains waveform, so that the zener diode Z1 begins to conduct just before the peak. The zener diode Z2 acts as a voltage regulator.

The delay circuit 22 is formed by the resistor R6 and a capacitor C4, which form an RC circuit with a time constant which is selected so that the switch element Q2 provides a pulse to the gate of the switch Q3 just as the mains waveform reaches its peak. At this point, the switch Q3 conducts, discharge the capacitors C1 and C2 through the primary winding 28 and generating a brief trigger pulse as described above. The exact timing of the trigger pulse can be adjusted by varying the values of the zener diode Z1, the resistors R3 and R6, and the capacitor C4. The resistors R7 and R8 define the operating conditions of the switch element Q2, which is typically a programmable uni-junction transistor (PUT) or an anode gated thyristor. (Other switching devices are also usable).

Two resistors R1 and R9 are included in the circuit as current limiting resistors and their values are selected according to the ratings of the power semi-conductors D2, D3 and Q3.

When the lamp ignites, the voltage across it will fall to approximately 150 V or lower, so that the zener diode Z1 is non conductive and the pulse generator is disabled.

Figure 2:
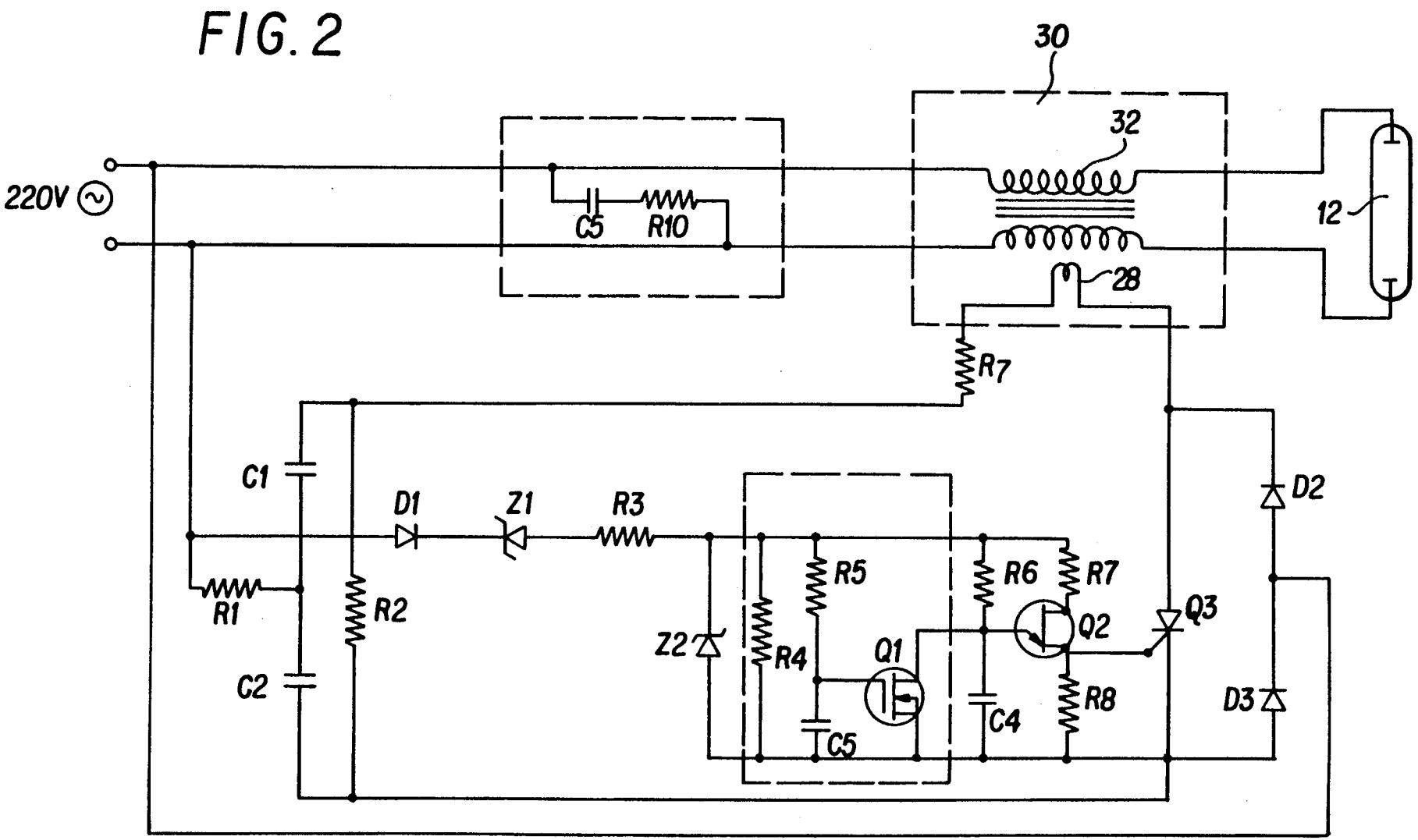
FIG. 2 is a schematic circuit of the ignition device of FIG. 1.

The circuit illustrated in FIG. 2 includes a cut-out circuit formed by resistors R4 and R5, a capacitor C3 and a field effect transistor (FET) Q1. Assuming that a mains waveform is present and exceeds the detection threshold of the circuit, so that the zener diode Z1 is conductive, the capacitor C3 will be charged via the resistor R5. After a period determined by the RC time constant of these two components, the voltage at the gate of the FET Q1 will rise sufficiently to turn the FET on, lowering the voltage at the junction of the resistor R6 and the capacitor C4 sufficiently to disable the pulse generator. If the lamp does not ignite within a time period of approximately five to ten seconds, the pulse generator is disabled and can only be reset by removing the mains supply for a period determined by the resistors R4 and R5 and the capacitor C3. The cut-out device provides a useful safety feature in the event of a fault, for example, where no lamp is fitted to its socket. This protects the lamp socket and its associated wiring, and limits the RFI which would otherwise be generated continuously. The cut-out circuit also prevents continual re-striking of hot lamps which have voltage/current characteristics beyond the rating of the ballast due, for example, to age.

Figure 3:
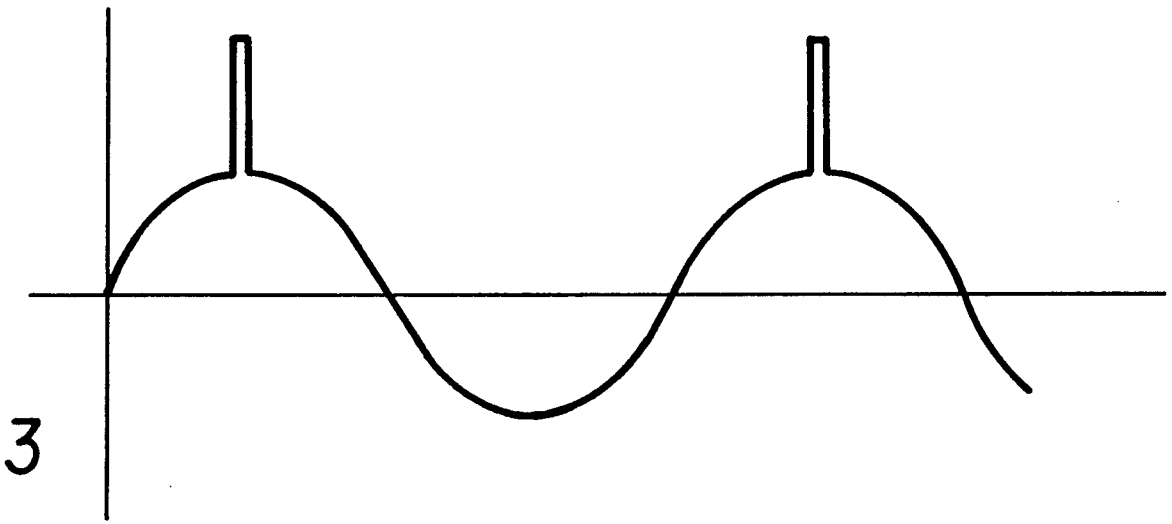
FIG. 3 is a schematic illustration of a typical waveform generated by the device.

FIG. 3, which is not to scale, illustrates a typical sinusoidal mains waveform with high voltage ignition pulses superimposed on the positive going peaks of the mains waveform, and shows the synchronisation of the ignition pulses with the mains waveform peaks. (The high frequency components of the ignition pulses are not shown).

Because the described ignition device accurately positions the ignition pulse at the peak of the AC mains waveform, it is only necessary that a singe trigger pulse be generated by the pulse generator. This has two particular advantages compared to conventional ignition systems which generate multiple pulses. Firstly, the power drawn by the ignition circuit is reduced, allowing the ignition device to be smaller but yet to be rated continuously. Secondly, the generation of RFI is greatly reduced. Futhermore, the reliability of lamp ignition is increased by the synchronisation of the ignition pulses with the mains waveform.

We claim:

1. An ignition device for a gas discharge which is driven by a source of electrical current having a periodic waveform, the device comprising a voltage multiplier which is adapted to be connected to the source and to provide an output having a higher voltage than that of the source; a pulse generator adapted to be driven by the output and to produce trigger pulses; sensing means for sensing the voltage of the source and for enabling the pulse generator when the voltage of the source exceeds a predetermined level, wherein the sensing means comprises a voltage dependent semiconductor device; timing means associated with the sensing means and the pulse generator and adapted to synchronize the enabling of the pulse generator with the occurrence of the peak in the waveform of the electrical source; and a resonant network having a primary winding to which the trigger pulses from the pulse generator are applied and a secondary winding which is in circuit with the lamp and which applies high-voltage ignition pulses to the lamp when the trigger pulses are applied to the primary winding, the ignition device thereby providing ignition pulses to the lamp automatically whenever the voltage of the source increases beyond the predetermined level, the ignition pulses being synchronized with peaks in the waveform of the electrical source.

2. An ignition device according to claim 1 wherein the sensing means comprises a zener diode.

3. An ignition device according to claim 1 wherein the sensing means is arranged to enable the pulse generator by supplying current to the pulse generator when the voltage of the source waveform exceeds the predetermined level.

4. An ignition device according to claim 3 wherein the predetermined level is between 80% and 100% of the peak voltage of the waveform.

5. An ignition device according to claim 3 wherein the timing means comprises a delay circuit having a time constant corresponding to the difference between the time at which the predetermined level is reached and the time at which the peak voltage of the source waveform is reached, so that the pulse generator produces a trigger pulse coincident with the peak of the source waveform.

6. An ignition device according to claim 5 wherein the delay circuit comprises an RC network.

7. An ignition device according to claim 1 wherein the pulse generator is adapted to produce a single trigger pulse each time the voltage of the source exceeds the predetermined level.

8. An ignition device according to claim 1 including a cut-out circuit adapted to disable the pulse generator if the peak voltage of the source exceeds a preset level for longer than a predetermined period.

* * * * *